US005767760A

United States Patent [19]

Mollie et al.

[11] Patent Number: 5,767,760

[45] Date of Patent: Jun. 16, 1998

[54] FOILS

[75] Inventors: Jean-Paul Mollie, Kooigem; Michael Ortner, Nivelles, both of Belgium

[73] Assignee: Dow Corning S. A., Seneffe, Belgium

[21] Appl. No.: 769,978

[22] Filed: Dec. 19, 1996

[30] Foreign Application Priority Data

Dec. 21, 1995 [GB] United Kingdom ..... 9526167

[51] Int. Cl.[6] ..... H01F 27/30

[52] U.S. Cl. ..... 336/205; 336/206

[58] Field of Search ..... 336/205, 206, 336/199, 209

[56] References Cited

U.S. PATENT DOCUMENTS

| | | | |
|---|---|---|---|
| 4,199,862 | 4/1980 | Gorton, Jr. et al. | 39/605 |
| 4,268,810 | 5/1981 | Iwasa et al. | 336/205 |
| 5,616,632 | 4/1997 | Fujiki et al. | 523/211 |

*Primary Examiner*—Michael L. Gellner
*Assistant Examiner*—Anh Mai
*Attorney, Agent, or Firm*—Sharon K. Severance

[57] ABSTRACT

Prior to winding wire in a coil around a foil, the foil is coated on a least one surface side with a tacky silicone composition. A composition on the foil exerts a retaining force on the wires discouraging said wires from sliding away from an original or intended position.

8 Claims, 1 Drawing Sheet

FOILS

BACKGROUND OF THE INVENTION

The present invention relates to foils and their manufacture and particularly to foils intended for use in coils and transformers.

Coils comprise wires generally made of copper, wound around a foil or insulated layer generally made of plastics material.

A problem generally met when manufacturing the coils by winding the wires in successive layers is an occurrence of irregularities in the said layers. If an imperfection in a winding occurs it leads to a sliding of the wires away from the original or intended position to an adjacent position. A space between the wires is generated.

The slide away problem occurs most frequently at an outerside of each layer, before or after insertion of an insulating layer between two successive layers of wires. Such irregularities in a wire assembly are detrimental for the coil as it leads to a modification in magnetic and electrical properties of the coil.

It is an object of the present invention to remedy this slide away problem.

According to one aspect the present invention provides a coil comprising a wire wound around a foil, characterised in that the foil has been coated on at least one surface side with a tacky silicone composition prior to wire winding.

SUMMARY OF THE INVENTION

The presence of a tacky layer of silicone composition on the foil exerts a retaining force on the wires discouraging said wires from sliding away from an original or intended position.

DETAILED DESCRIPTION OF THE PREFERRED EMBODIMENT

In a foil for use according to the invention, preferably the tacky layer of silicone composition is formed by use of a solvent-free platinum cured silicone coating. The silicone coating is formed by use of an addition cured elastomer which affords a high temperature resistance and absence of shrinkage during cure and requires low cure rate at room temperature to exhibit tackiness. The tackiness is provided when using an under crosslinked silicone composition. Preferred silicone compositions may be made by bringing about chemical reaction between a linear or branched alkenyl-containing polyorganosiloxane having at least 0.1% by weight of alkenyl groups and made up, for example, of repeating units of diorganosiloxane, monoorganosilsesquioxane units and triorganosiloxy units, a cross linker provided by a silicon-bonded hydrogen containing polysiloxane having at least 0.5% by weight silicon-bonded hydrogen atoms made up of alkylhydrogensiloxane units of di- or tri-organosiloxane units, a noble metal catalyst and preferably a heat stability additive, for example a zirconium or titanium-containing methylpolysiloxane. The alkenyl groups of the siloxane units may be, for example, vinyl or allyl. The organo group of the siloxane units may be a hydrocarbon e.g. methyl, ethyl, propyl, isopropyl, butyl, octyl or phenyl group or a monovalent halogenated hydrocarbon group. The noble metal catalyst may be for example a rhodium or platinum-containing material. Platinum catalysts may take any of the known forms ranging from platinum as deposited on carriers such as silica gel or powdered charcoal, to platinic chloride, salts of platinum and chloroplatinic acids. A preferred form of platinum is chloroplatinic acid either as the commonly obtainable hexahydrate or the anhydrous form, on account of its dispersibility in organosilicon systems and its non-effect on colour of the mixture. Platinum complexes may also be used, e.g. those prepared from chloroplatinic acid hexahydrate and divinyl tetramethyldisiloxane.

Silicone compositions for use in the invention cure slowly when the component parts have been mixed together and applied on the foil. Preference is given to alkenyl/crosslinker ratios superior to 1. If it is desired to further delay the cure one may include in the composition one of the known platinum catalyst inhibitors such as polymethylvinylsiloxane cyclic compound or an acetylenic alcohol.

Silicone compositions for use in the present invention are applied by any suitable means. They may be applied on the foil by conventional paper coating techniques for example as described in G.B. 1 374 792 and a very thin layer of silicone composition may be obtained varying from less than 1 to 3 microns. Or it may be applied by conventional spraying or dipping techniques and a thicker layer of 1 to 200 microns obtained. Thickness of the coating can be varied in the spraying or dipping technique by varying the viscosity of silicone composition used. A thin silicone composition of less than 300 cSt is preferably applied on the foil.

In a preferred embodiment of the invention the tacky layer of silicone composition has a thickness between 0.1 and 10 microns, most preferably between 0.5 and 3 microns.

After application on the foil the thin silicone liquid film is then allowed to cure at room temperature for several hours. The cure can be accelerated by passing the layer of silicone composition through a heating zone. The temperature in the heating zone may be adjusted between 30° and 120° C.

In a preferred embodiment of the invention the foil is made of polystyrene or polyester.

The present invention also provides a method of making a coil, the method comprising winding a wire around a foil characterised in that the foil is coated on at least one surface side with a tacky silicone composition prior to wire winding.

In a method according to the invention, the wire is wound into successive layers and the foil is applied.

In a preferred method of the invention the silicone composition is as specified above.

BRIEF DESCRIPTION OF THE DRAWINGS

The invention will now be described in more detail with reference to the drawings in which.

In the description all parts are expressed by weight and viscosities are at 25° C.

DETAILED DESCRIPTION OF THE DRAWINGS

Figure 1:
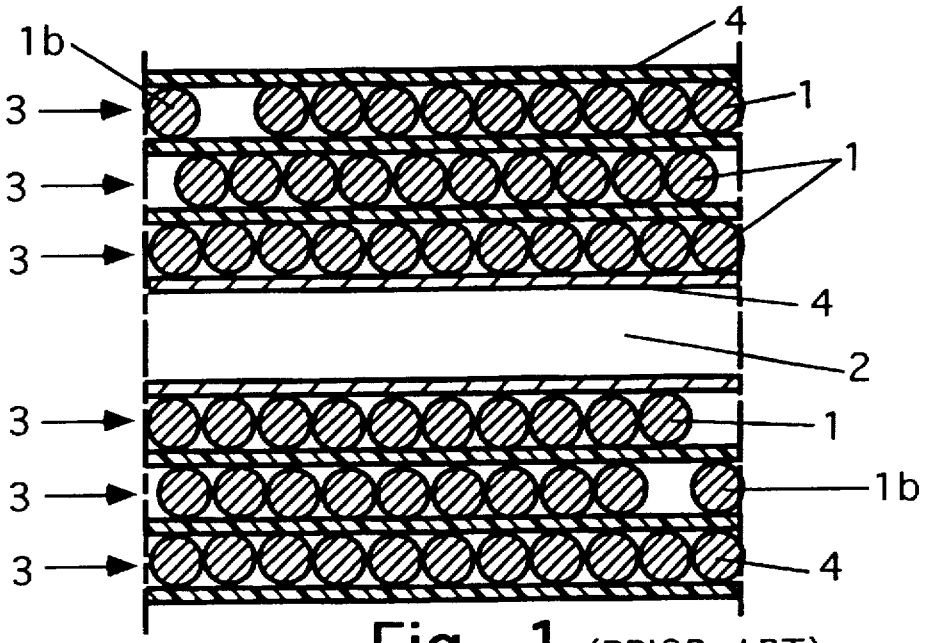
Fig. 1 (PRIOR ART)
FIG. 1 is a diagram of a cross section through a fragment of a coil made by use of prior art techniques and showing voids between some turns of a wire thereof resulting from the slide away problem.

FIG. 1 illustrates a coil comprising wires (1) wound around a coil former (2) in successive layers (3) separated from each other by a foil (4). In this example according to the prior art processes, the foil (4) employed was an untreated polyester foil. Imperfection of the winding procedure leads to a slide away of the wires (see 1*b*) from their original position, particularly on the outside of each layer. Such irregular assembling of wires leads to a magnetic and electrical modification of the coil properties.

Figure 2:
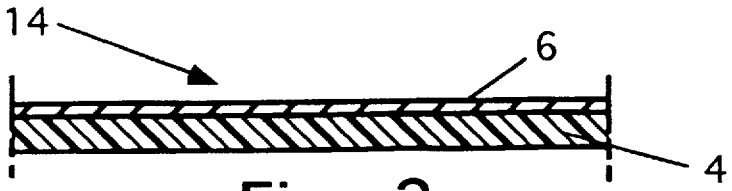
FIG. 2 is a diagram of a cross-section through a fragment of a foil having a tacky layer for use in a coil according to the invention.

FIG. 2 illustrates a foil (14) prepared according to the present invention comprising a tacky layer (6) of silicone composition on the upper surface of a foil (4) to retain wires (16) when wound around a coil former. The foil was prepared by forming on a polyester film (4) a layer (6) of a silicone composition. The silicone composition was formed by mixing a part A comprising 98 parts of a dimethylvinylsiloxy terminated polydimethylsiloxane having a viscosity of about 2000 cSt and 2 parts of a complex of platinum, with a part B having a viscosity of about 17 cSt and comprising 75 parts of a methylhydrogen polysiloxane and 20 parts of a dimethyl hydrogen polysiloxane.

The parts A and B were employed in proportions to ensure a less than stoichiometric amount of silicon-bonded hydrogen atoms to silicon-bonded vinyl groups in order to ensure a tacky surface on the cured silicone layer. The composition was allowed to cure at room temperature.

Figure 3:
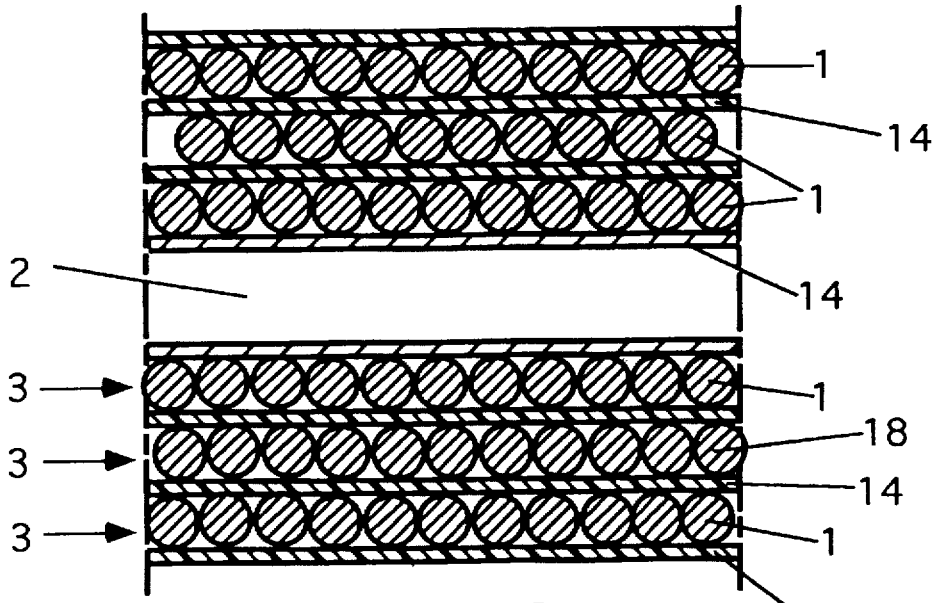
FIG. 3 is a diagram of a cross section through a coil according to the present invention.

FIG. 3 shows a coil according to the present invention comprising wires (18) wound around a coil former (2) in successive layers (3) separated from each other by a foil (14). Presence of the tacky layer of silicone on the polyester foil surface served to retain the turns of the wire in their allotted positions.

That which is claimed is:

1. A coil comprising a wire wound around a foil, the improvement comprising the foil has been coated on at least one surface side, with a tacky silicone composition prior to wire winding.

2. A coil according to claim 1 wherein the tacky silicone composition has been formed from a solvent free platinum cured silicone coating.

3. A coil according to claim 1 wherein the tacky silicone composition has a thickness from 0.5 to 3 microns.

4. A coil according to claim 1 wherein the foil is selected from the group consisting of polyester and polystyrene.

5. A method of making a coil, the method comprising winding a wire around a foil wherein the foil is coated with a tacky silicone composition prior to wire winding.

6. A method according to claim 5 wherein the silicone composition is a solvent free platinum cured silicone coating.

7. A method according to claim 5 wherein the silicone composition has a thickness from 0.5 to 3 microns.

8. A method of retaining wires wound in a coil, the method comprising (a) applying on at least one surface side of a foil, a tacky silicone composition and (b) winding a wire around the foil.

* * * * *